United States Patent [19]

Usbeck

[11] 4,229,266

[45] Oct. 21, 1980

[54] PROCESS FOR ANODICALLY OXIDIZING ALUMINUM AND USE OF THE MATERIAL SO PREPARED AS A PRINTING PLATE SUPPORT

[75] Inventor: Gerhard Usbeck, Wiesbaden, Fed. Rep. of Germany

[73] Assignee: Hoechst Aktiengesellschaft, Fed. Rep. of Germany

[21] Appl. No.: 67,391

[22] Filed: Aug. 17, 1979

[30] Foreign Application Priority Data

Aug. 23, 1978 [DE] Fed. Rep. of Germany ..... 2836803

[51] Int. Cl.[2] ..... C25D 11/04; C25D 11/08; C25D 11/16; C25D 11/18

[52] U.S. Cl. ..... 204/33; 204/38 A; 204/58

[58] Field of Search ..... 204/17, 38 A, 38 E, 204/33, 58

[56] References Cited

U.S. PATENT DOCUMENTS

| | | | |
|---|---|---|---|
| 3,714,001 | 1/1973 | Dorsey Jr. | 204/58 |
| 3,902,976 | 9/1975 | Walls | 204/38 A |
| 3,935,080 | 1/1976 | Gumbinner | 204/33 |
| 4,144,142 | 3/1979 | Takahashi | 204/58 |

FOREIGN PATENT DOCUMENTS

| | | | |
|---|---|---|---|
| 679599 | 9/1952 | United Kingdom | 204/58 |
| 467267 | 6/1937 | United Kingdom | 204/58 |

OTHER PUBLICATIONS

Chemical Absracts, vol. 87, No. 6, 08-08-1977, p. 440, Citation 45802a.

Chemical Abstracts, vol. 84, No. 12, 03-22-1976, p. 535, Citation 81702q.

*Primary Examiner*—T. M. Tufariello

*Attorney, Agent, or Firm*—James E. Bryan

[57] ABSTRACT

This invention relates to an improvement in the process for anodically oxidizing materials in the form of strips, foils, or sheets composed of aluminum or aluminum alloys in an aqueous electrolyte containing sulfuric acid and phosphoric acid, if appropriate, after a previous mechanical, chemical or electrochemical roughening, the improvement which comprises anodically oxidizing the material in an electrolyte having a concentration of sulfuric acid ranging from about 25 to 150 g per liter, of phosphoric acid ranging from about 10 to 50 g per liter, and of aluminum ions ranging from about 5 to 25 g per liter, at a current density ranging from about 4 to 25 $A/dm^2$, and a temperature ranging from about 25° to 65° C.

5 Claims, No Drawings

PROCESS FOR ANODICALLY OXIDIZING ALUMINUM AND USE OF THE MATERIAL SO PREPARED AS A PRINTING PLATE SUPPORT

This invention relates to a process for anodically oxidizing aluminum, to the use of the material prepared according to this process as a printing plate support, and to a method for the manufacture of a printing plate support material.

During the past decades a tendency towards a steady improvement of the material surfaces has been observed in the processing of aluminum or aluminum alloys, e.g. in the form of strips, foils, or sheets, in order to prepare these surfaces for the most diversified applications. Among the different properties which are desired with respect to the surface are: corrosion resistance, appearance, density, hardness, abrasion resistance, receptivity and adhesion to lacquer or synthetic resin coatings, receptivity to dyes, gloss, etc. Based on bright-rolled aluminum, development took its course over chemical, mechanical, and electrochemical methods for the surface treatment, and, in practice, combinations of the various methods also are being employed.

Particularly in the processing of materials of this kind in the form of strips, foils, or sheets composed of aluminum or aluminum alloys, which are to be used as support materials for (planographic) printing plates, technical development, has, for the time being, found its conclusion in a generally acceptable combination of a usually mechanical or electrochemical roughening step with an ensuing treatment by anodic oxidation of the roughened aluminum surface. Depending upon the desired number of prints to be made from the treated printing plate, anodic oxidation procedures also may be performed on aluminum materials which have not been subjected to a separate roughening treatment. In this case, the surfaces of the materials merely must be such that a sufficiently adhesive aluminum oxide layer can be produced thereon by anodic oxidation, and the aluminum oxide layer, in turn, should enable a good adhesion of a light-sensitive layer to be applied thereto.

Anodic layers on (planographic) printing plates help, above all, to improve hydrophilic properties and to increase resistance to abrasion and thus, for example, to prevent a loss of printing areas on the surface during the printing operation. In addition, they provide, for example, for an improved adhesion of the light-sensitive layer.

Due to their natural porosity, conventional anodic layers, however, have some disadvantages. Depending upon the anodizing conditions, they have an increased sensitivity to alkali which may, for example, be contained in the usual compositions used for developing the light-sensitive layers or in the fountain solution, and they also show a more or less strong irreversible adsorption of substances contained in the applied coating. This adsorption may give rise to the so-called "staining," i.e., to a discoloration of the oxide layer, which becomes visible in the image-free areas of the printing plate following development of the exposed light-sensitive layer. This "staining" shows particularly clearly if a chemical correction is carried out, which is frequently necessary, particularly in positive-working plates, for example, in order to remove film edges on the printing image. In this case, the substances which cause "staining" are dissolved even deeply out of the oxide layer, so that the corrected zones appear as light areas upon a toned background. In the most unfavorable case, the sensitivity to alkali and the correction marks mentioned result in difficulties in printing, which may become apparent as a scumming propensity of the printing plates in their image-free areas and as a reduction of the length of printing runs obtained with the printing plates.

From the prior art the following standard methods for the anodic oxidation of aluminum in aqueous electrolytes containing $H_2SO_4$ are known (see for example, M. Schenk: "Werkstoff Aluminium und seine anodische Oxydation," Francke Verlag, Bern, 1948, page 760; "Praktische Galvanotechnik," Eugen G. Leuze Verlag, Saulgau, 1970, page 395 et seq. and pages 518/519; W. Hübner, and C. T. Speiser: "Die Praxis der anodischen Oxidation des Aluminiums", Aluminium Verlag, Düsseldorf, 1977, 3rd Edition, page 137 et seq.), with $H_2SO_4$ having proved to be the most useful electrolytic acid for most applications.

1. Direct current—sulfuric acid process:

In this process an aqueous electrolyte is used which normally contains about 230 g of $H_2SO_4$ per liter of solution, and the anodic oxidation is carried out during 10 to 60 minutes at a temperature of from 10° to 22° C. and a current density of from 0.5 to 2.5 A/dm$^2$. The concentration of sulfuric acid in the aqueous electrolyte solution may be reduced to 8 to 10 percent by weight of $H_2SO_4$ (approximately 100 g of $H_2SO_4$ per liter) or increased to 30 percent by weight (365 g of $H_2SO_4$ per liter) or more. Due to the $Al^{3+}$ ions formed from Al atoms during the anodic oxidation, there is always a particular proportion of $Al^{3+}$ ions in the aqueous electrolyte containing $H_2SO_4$, and this proportion is kept as stable as possible, in order to obtain reproducible results with respect to the properties of the layer. A stable concentration of $Al^{3+}$ ions is achieved by continuously regenerating the electrolyte, so that the content of $Al^{3+}$ ions is maintained in the range between about 8 and about 12 g of $Al^{3+}$ per liter. An aqueous electrolyte which contains $H_2SO_4$ and is suitable for the process in question is depleted at the latest when it contains about 15 to 18 g of $Al^{3+}$ per liter. Values exceeding 12 g of $Al^{3+}$ per liter are, if possible, avoided in practice.

2. "Hard anodizing":

This process is carried out in an aqueous electrolyte containing $H_2SO_4$ and having a concentration of 166 g of $H_2SO_4$ per liter (or about 230 g of $H_2SO_4$ per liter), at an operating temperature of 0° to 5° C., a current density of from 2 to 3 A/dm$^2$, and a rising voltage amounting to about 25 to 30 V at the beginning and to about 40 to 100 V towards the end of the treatment which requires from 30 to 200 minutes.

For many fields of application these processes provide suitable oxide layers on aluminum, however, when used, for example, for the preparation of support materials for printing plates they exhibit some disadvantages. These include, on the one hand, an increased sensitivity to alkali of the layers so produced and "staining" and, on the other hand, particularly in "hard anodizing," the energy which has to be applied to attain and keep constant the low temperatures of the electrolyte, and the periods during which the aluminum stays in the electrolyte, which are relatively long for the economically favorable continuous anodization of aluminum.

To improve the properties of oxide layers, particularly in support materials for printing plates, other known anodizing processes, in which additions of various organic compounds or of chromic acid are employed, are likewise not suitable, because they result in more or less strongly dyed oxides. Also phosphoric acid, used as the only electrolyte or in mixtures, up to the present, has not been of any importance or only of secondary importance for anodizing processes which are suitable for large-scale technical applications. If this acid is used, the growth of the layers is such that only relatively thin layers are obtained. These thin layers, however, are not compact enough to be able to compete with layers produced, for example, from borates or citric acid, e.g., as the forming layers for capacitors (cf M. Schenk, "Werkstoff Aluminium und seine anodische Oxydation," Francke Verlag, Bern, 1948, page 324). The strong redissolving capacity of phosphoric acid towards aluminum oxide is not only a possible explanation for that particular behavior (cf. M. Schenk, page 385), but also for the fact that thicker and abrasion-resistant oxide layers can either not at all be prepared or only with difficulty be prepared under economically justifiable conditions. This redissolving capacity is probably also the reason for the large-pored structure of the oxide layers prepared in phosphoric acid (cf. M. Schenk, page 585) and for the inferior abrasion resistance of these layers.

In the processes for the anodic oxidation of aluminum known from the prior art, modified electrolytes based on phosphoric acid are, therefore, described in the first place.

The process for the anodic treatment of articles made of aluminum according to German Pat. No. 821,898 includes an anodic brightening step which is carried out in a bath containing, by weight, 70% of $H_2SO_4$, 20% of $H_3PO_4$ and 10% of water, at a current density of 15 to 30 A/dm$^2$, a temperature ranging between 70° and 90° C., during 3 to 5 minutes, and results in glossy and reflecting surfaces.

From German Pat. No. 825,937 a process is known for anodically brightening articles made of aluminum, in which a bath is used which contains, by weight, from 40 to 60% of $H_2SO_4$, from 5 to 35% of $H_3PO_4$, from 5 to 25% of sulfonic acids of benzene, with the remaining percentage being made up of water, at a temperature ranging from 65° to 100° C.

In German Pat. No. 957,616, a process is described for the galvanic preparation of uniformly grained, glossy surfaces on aluminum, in which the electrolyte contains from 40 to 70% by volume of $H_2SO_4$, from 0 to 20% by volume of $H_3PO_4$, from 2 to 5% by volume of $HNO_3$, from 0.5 to 2% by volume of HF and a wetting agent. The temperature of the electrolyte ranges between about 60° and 100° C., at a duration of the treatment from 3 to 10 minutes and a current density ranging between about 30 and 40 A/dm$^2$ at the beginning and between about 10 and 15 A/dm$^2$ towards the end of the treatment.

In the anodizing stage of the process for the preparation of a lithographic printing plate according to German Pat. No. 1,671,614 (corresponding to U.S. Pat. No. 3,511,661), which results in an anodized aluminum support, 42, 50, 68 or 85% concentration $H_3PO_4$ is allowed to act at a temperature of at least 17° C. The current densities employed are 1.615, 2.153, 2.583 or 2.691 A/dm$^2$, the thickness of the aluminum oxide layer is at least $50 \cdot 10^{-9}$, and the cells of the aluminum oxide layer have widths ranging between 15 and $75 \cdot 10^{-9}$.

The process for the preparation of offset printing plates composed of aluminum according to German Offenlegungsschrift No. 1,956,795 (corresponding to British Pat. No. 1,240,577) includes, among others, an anodizing stage, in which the previously etched printing plate is anodized for 10 minutes in a bath containing 7.5% by volume of $H_2SO_4$ and 5% by volume of $H_3PO_4$, at a temperature of 23.9° C. and a current density of 1.08 A/dm$^2$.

From German Offenlegungsschrift No. 2,251,710 (corresponding to British Pat. No. 1,410,768) a process is known for the manufacture of supports for printing plates, in which an aluminum support which has been anodically oxidized in an electrolyte containing $H_2SO_4$, is subjected to a non-electrolytic after-treatment in an aqueous $H_3PO_4$ solution. In one of the examples given also a mixed electrolyte composed of 15% concentration $H_2SO_4$ and 5% concentration $H_3PO_4$ is used for the anodic oxidation during 8 minutes, at 20° C. and at a current density of 2.5 A/dm$^2$.

German Offenlegungsschrift No. 2,314,295 (corresponding to U.S. Pat. No. 3,808,000) discloses a process for treating a printing plate surface composed of aluminum, in which the surface which has been anodically oxidized in $H_2SO_4$ is non-electrolytically after-treated in an aqueous $H_3PO_4$ solution.

In the process for the anodic pretreatment of an elongate aluminum material according to German Auslegeschrift No. 2,522,926, an aqueous solution containing, by weight, from 10 to 25% of $H_2SO_4$ and from 20 to 50% of $H_3PO_4$ is employed at temperatures exceeding 80° C. At a current density of 100 A/dm$^2$ the pretreatment is completed within about 5 to 6 seconds. The bath serves to dissolve aluminum oxide at high current densities and within short periods of time.

The process for the preparation of dyed anodically treated aluminum according to German Offenlegungsschrift No. 2,548,177 includes an anodizing stage, in which the aluminum is anodically treated in a bath containing $H_3PO_4$ and a small amount of another acid, for example, $H_2SO_4$. As a specific example, a bath composed of $H_3PO_4$ (80 g per liter) and $H_2SO_4$ (10 g per liter) is mentioned, wherein the aluminum is treated for 2 minutes. Prior to this treatment, however, the surface already has been anodically oxidized in $H_2SO_4$ (165 g per liter) during 30 minutes, at a temperature of 20° C. and a current density of 1.5 A/dm$^2$.

From German Offenlegungsschrift No. 2,707,810 (corresponding to U.S. Pat. No. 4,049,504) a process for the manufacture of offset printing plates is known, in which metal sheets (in particular aluminum sheets) are anodically oxidized in an aqueous solution containing $H_2SO_4$ and $H_3PO_4$. The current densities range from 1 to 16 A/dm$^2$, the temperatures of the electrolyte solution range from 25° C. to 50° C., and the anodizing times range from 15 seconds to 3 minutes. For every 1 to 3 parts by weight of $H_2SO_4$ the acid mixture contains from 3 to 1 part by weight of $H_3PO_4$, and the acid concentration ranges between 5 and 40% by weight.

German Offenlegungsschrift No. 2,729,391 describes a process for the manufacture of a support plate for lithographic purposes, in which a porous oxidized layer is produced in an electrolyte containing a mixture of $H_3PO_3$ (phosphorous acid) and $H_2SO_4$; the current density should, in that case, amount to about 0.1 to 2 A/dm$^2$.

The process for anodically oxidizing aluminum according to French Pat. No. 1,285,053 serves as a preliminary stage prior to the application of a chromium or nickel layer and is carried out in an electrolyte containing from 5 to 45% by volume of $H_3PO_4$, from 1 to 30% by volume of $H_2SO_4$ and from 25 to 94% by volume of water, at a temperature from 27° C. to 60° C., a duration from 1 to 30 minutes, and a current density from 1.3 to 13 A/dm$^2$.

The anodic oxidation according to U.S. Pat. No. 2,703,781 results in bright, well reflecting surfaces on aluminum and is carried out in an electrolyte containing from 15 to 40% by weight of $H_3PO_4$, from 2 to 10% by weight of $H_2SO_4$ and from 50 to 83% by weight of water, at a current density from about 0.5 to 3 A/dm$^2$, a duration from 0.5 minute to 50 minutes, and a temperature ranging from 15° C. to 32° C.

From U.S. Pat. No. 3,940,321 a process for the treatment of aluminum is known, in which the aluminum is anodically oxidized using first $H_2SO_4$ and then $H_3PO_4$.

German Offenlegungsschrift No. 2,811,396 which has not yet been published proposes a process for anodically oxidizing materials in the form of strips, foils or sheets composed of aluminum or aluminum alloys, in an aqueous electrolyte containing $H_2SO_4$ and $Al^{3+}$ ions. In this process, the electrolyte has a concentration of $H_2SO_4$ ranging from 25 to 100 g per liter and of $Al^{3+}$ ions ranging from 10 to 25 g per liter, at a current density ranging from 4 to 25 A/dm$^2$, and a temperature ranging from 25° C. to 65° C.

These processes for the anodic oxidation of aluminum or aluminum alloys which are known from the prior art and/or the materials prepared according to these processes, particularly support materials for printing plates, have, however, some disadvantages: the problems involved with aluminum oxide layers produced in $H_3PO_4$ as the only electrolytic acid already have been pointed out above, but also the layers produced in mixed electrolytes containing $H_2SO_4$ and $H_3PO_4$ cannot be used in all fields of application. At a high concentration of the electrolyte in the anodizing bath of, for example, more than 50%, the polishing and levelling effect outweighs the growth of the layer, so that the structure of the surface which is required for a good anchoring of a layer to be applied (for example, a light-sensitive layer) cannot be obtained; much the same applies also if high temperatures, for example, exceeding 65° C. to 70° C. are used during the anodizing procedure. Low current densities of less than about 2 A/dm$^2$ or high current densities of more than about 30 A/dm$^2$, in combination with anodizing times of more than about 1.5 to 2 minutes, also result in layers which either grow too slowly for a large-scale technical application or grow with an excessive porosity, or in which the layer buildup is too low or does not take place at all, because the redissolving capacity of the electrolyte is predominant. If aluminum oxide layers produced in $H_2SO_4$ are non-electrolytically or anodically after-treated in solutions containing $H_3PO_4$, parts of the previously formed oxide layers are dissolved again, so that disturbances may be experienced, particularly with respect to the abrasion resistance, adsorption capacity and structure of the surface, which, for example, in support materials for printing plates, may lead to the aforementioned increased susceptibility to alkali and "staining."

It is, therefore, an object of the present invention to provide a process for the preparation of anodically oxidized aluminum, which makes use of the advantages of the electrolyte types $H_2SO_4$ and $H_3PO_4$, without incurring the disadvantages described above, i.e. a process which permits the production of abrasion-resistant, alkali-resistant, low-porosity aluminum oxide layers of sufficient thickness on aluminum strips, foils, or sheets, at an economically justifiable cost of energy.

The invention is based on the known process for anodically oxidizing strip, foil, or sheet-shaped materials composed of aluminum or aluminum alloys, in an aqueous electrolyte containing sulfuric acid and phosphoric acid, if appropriate, after a previous mechanical, chemical or electrochemical roughening. In the inventive process, the material is anodically oxidized in an electrolyte having a concentration ranging from 25 to 150 g of sulfuric acid per liter, from 10 to 50 g of phosphoric acid per liter and from 5 to 25 g of aluminum ions per liter, at a current density ranging from 4 to 25 A/dm$^2$, and a temperature ranging from 25° to 65° C. In a preferred embodiment, the process having the above-mentioned features serves to prepare a support material for printing plates in the form of strips, foils or sheets. In the following, the term "printing plate" is generally meant to denote a printing plate for planographic printing, mainly composed of a planar support comprising one or more materials and one or more likewise planar light-sensitive layers applied to the support.

The process is, particularly, carried out in an electrolyte having a concentration ranging from 25 to 100 g of sulfuric acid per liter, from 20 to 40 g of phosphoric acid per liter, and from at least 10 g, preferably from 12 to 20 g, of aluminum ions per liter, at a current density ranging from 6 to 15 A/dm$^2$, and a temperature ranging from 35° to 55° C.

As the metal base constituting the strip, foil, or sheet-shaped material, aluminum or an aluminum alloy is used. The preferred materials (which are also used in the examples below) are: —"Pure Aluminum" (German Industrial Standard Material—DIN-Werkstoff No. 3.0255) comprising ≧99.5% of Al and the following permissible impurities (total 0.5% max.): Si 0.3%, Fe 0.4%, Ti 0.03%, Cu 0.02%, ZN 0.07%, and others 0.03%, or —"Al-Alloy 3003;; (comparable to German Industrial Standard Material—DIN-Werkstoff No. 3.0515) comprising ≧98.5% of Al and as alloying elements: Mg 0 to 0.3% and Mn 0.8 to 1.5%, and the following permissible impurities: Si 0.5%, Fe 0.5%, Ti 0.2%, Zn 0.2%, Cu 0.1%, and others 0.15%.

The electrolyte is prepared from concentrated $H_2SO_4$, concentrated $H_3PO_4$, water, and an added aluminum salt, particularly aluminum sulfate, in such a manner that it contains, per liter of the electrolyte, from 25 to 150 g of $H_2SO_4$, preferably from 25 to 100 g of $H_2SO_4$, from 10 to 50 g of $H_3PO_4$, preferably from 20 to 40 g of $H_3PO_4$, and from 5 to 25 g of dissolved $Al^{3+}$ ions, preferably from 10 g, in particular from 12 to 20 g of $Al^{3+}$ ions. The ranges of concentration of the electrolyte components are checked at regular intervals, because they are decisive for optimum process conditions. The electrolyte is then discontinuously or, preferably, continuously regenerated. A detailed description of the preparation, control and regeneration of the electrolytes in the anodic oxidation of aluminum is given in "Die Praxis der anodischen Oxidation des Aluminiums" by W. Hübner and C. T. Speiser, Aluminium Verlag, Düsseldorf, 1977, 3rd Edition, pages 141 to 148 and 154 to 157. This publication also contains fundamental information on the mode of operation in the anodic oxidation of aluminum (pages 149 to 150).

The process according to the invention may be performed discontinuously or, preferably, continuously. An apparatus which is suitable for carrying out the continuous process is, for example, described in German Auslegeschrift No. 2,234,424 (corresponding to U.S. Pat. No. 3,871,982). This apparatus comprises a treatment tank filled with the electrolyte, one inlet and outlet aperture each for the metal strip to be treated provided in the two end walls of the tank below the liquid level of the electrolyte, at least one electrode arranged above the metal strip, and means for producing a rapid flow of the electrolyte between the path of travel of the strip and the electrode surface. The flow of the electrolyte is produced by a bell-shaped chamber each, arranged close to each end wall of the treatment tank, the bell chamber having an overflow for the electrolyte with a liquid drain pipe leading into a reserve container disposed below the treatment tank, a gas space isolated from the ambient atmosphere above the liquid level, and a gas discharge pipe leading out of this gas space and connected with a suction pump. In addition, the apparatus is provided with a pump for conveying the electrolyte from the reverse container into the treatment tank.

Apparatuses for treatment constructed in a different way are also suitable for the process according to the invention, as long as they ensure the conditions specified in the following, with respect to duration of treatment, agitation of electrolyte and exchange of substances and heat.

In the process according to the invention, the duration of the anodic oxidation, i.e. the time during which a point of the material surface is within the sphere of influence of the electrode(s), is appropriately in the range between 5 and 60 seconds, preferably between 10 and 35 seconds. In this manner, the weight of the aluminum oxide layer obtained may range from 1 to 10 $g/m^2$ (corresponding to a layer thickness of about 0.3 to 3.0 $\mu m$), preferably from about 2 to about 4 $g/m^2$.

When carrying out the inventive process in practice, it is necessary to provide for a proper circulation of the electrolyte. This may be achieved by agitating or pump-circulating the electrolyte. When the continuous process is employed (see for example German Auslegeschrift No. 2,234,424) care must be taken that the electrolyte is conveyed, as far as possible, in parallel with the strip to be treated and that a turbulent electrolyte flow at high speed is produced, so that a good exchange of substances and heat is ensured. The rate of flow of the electrolyte relative to the strip is then appropriately more than 0.3 m/second. In the anodic oxidation process direct current is preferably used; it is, however, also possible to use alternating current or a combination of these kinds of current (for example, direct current with superimposed alternating current, and the like).

The process according to the invention for the anodic oxidation of aluminum may be preceded by one or more pretreating steps, particularly a roughening step—especially in the case of the application of the process to the preparation of a support material for printing plates. Pretreating includes either a mechanical surface treatment by grinding, polishing, brushing, or blast-abrasion, or a chemical surface treatment for degreasing, pickling, or producing a mat surface, or an electrochemical surface treatment by the action of electric current (usually alternating current) in an acid, for example HCl or $HNO_3$. Of these pretreating steps, especially the mechanical and the electrochemical treatment of the aluminum result in roughened surfaces. When these methods are employed, the average depth of roughening $R_z$ is in the range between about 1 and about 15 $\mu m$, particularly in the range between 4 and 8 $\mu m$.

The depth of roughening is determined in accordance with German Industrial Standard DIN 4768, October 1970 edition. Accordingly, the average depth of roughening $R_z$ is the arithmetic mean of the individual depths of roughening of five adjoining individually measured sections. The individual depth of roughening is defined as the distance of two parallel lines from a middle line between them, with the two parallel lines contacting the highest and the lowest points of the roughness profile within the individually measured section. The individually measured section corresponds to one fifth of the length of the section of the roughness profile, which is projected at a right angle onto the middle line and is directly used for evaluation. The middle line is the line which extends in parallel with the general direction of the roughness profile and which has the shape of the geometrically ideal profile and divides the roughness profile in such a manner that the sum of the areas filled with material above it and the sum of the areas free from material below it are equal.

The inventive process for the anodic oxidation of aluminum may—particularly in the case of the application of the process to the preparation of a support material for printing plates—be followed by one or more post-treating or conditioning steps. By "post-treating" or conditioning a chemical or electrochemical treatment of the aluminum oxide layer is, particularly, understood, for example an immersion treatment of the material in an aqueous solution of polyvinyl phosphonic acid according to German Pat. No. 1,621,478 (corresponding to British Pat. No. 1,230,447), or an immersion treatment in an aqueous solution of alkali silicate according to German Auslegeschrift No. 1,471,707 (corresponding to U.S. Pat. No. 3,181,461), or an electrochemical treatment (anodization) in an aqueous solution of alkali silicate according to German Offenlegungsschrift No. 2,532,769 (corresponding to U.S. Pat. No. 3,902,976). These conditioning steps serve, in particular, to improve the hydrophilic properties of the aluminum oxide layer, which are already sufficient for many fields of application, with the well-known good properties of the layer being at least maintained.

A material which has been anodically oxidized according to the inventive process and which, if appropriate, has been pretreated and/or conditioned, is particularly suitable for use as a support material for printing plates carrying a light-sensitive layer. In this case, the support material is, either at the manufacturer of presensitized printing plates or at the user, coated with one of the following light-sensitive compositions:

Basically, any light-sensitive layers are suitable which after exposure, if necessary followed by developing and/or fixing, provide an area in imagewise distribution, which may be used for printing.

Apart from the layers containing silver halides, which are used in many fields of application, various other layers are known, such as are described, for example, in "Light-Sensitive Systems," by Jaromir Kosar, John Wiley & Sons, New York, 1965. These include: the colloid layers containing chromates or dichromates (Kosar, Chapter 2); the layers containing unsaturated compounds, in which these compounds are isomerized, transposed, cyclized, or cross-linked during exposure (Kosar, Chapter 4); the layers containing photopolymerizable compounds, in which monomers or prepolymers are polymerized by exposure, if appropriate by means of an initiator (Kosar, Chapter 5); and the layers containing o-diazoquinones, for example, naphthoquinone-diazides, p-diazoquinones or diazonium salt condensates (Kosar, Chapter 7). Among the suitable layers are also the electrophotographic layers, i.e. layers containing an inorganic or organic photoconductor. In addition to the light-sensitive substances these layers also may naturally contain further components, for example, resins, dyes or plasticizers.

The following light-sensitive compositions or compounds may, particularly, be used for coating the support materials prepared according to the inventive process:

Positive-working o-quinone diazide compounds, preferably o-naphthoquinone diazide compounds, which are described, for example, in German Pat. Nos. 854,890; 865,109; 879,203; 894,959; 938,233; 1,109,521; 1,114,705; 1,118,606; 1,120,273; and 1,124,817.

Negative-working condensation products from aromatic diazonium salts and compounds containing active carbonyl groups, preferably condensation products from diphenylamine diazonium salts and formaldehyde, which are described, for example, in German Pat. Nos. 596,731; 1,138,399; 1,138,400; 1,138,401; 1,142,871; and 1,154,123, in U.S. Pat. Nos. 2,679,498 and 3,050,502, and in British Pat. No. 712,606.

Negative-working mixed condensation products from aromatic diazonium compounds (for example, according to German Offenlegungsschrift No. 2,024,244) which comprise at least one unit of each of the general types A $(-D)_n$ and B, which are linked by a divalent intermediate member derived from a carbonyl compound capable of condensation; the symbols being defined as follows: A is a radical of a compound containing at least two members selected from an aromatic ring and/or a heterocyclic ring of aromatic nature, which compound is capable of condensation in at least one position with an active carbonyl compound in an acid medium. D is a diazonium salt group linked to an aromatic carbon atom of A; n is an integer from 1 to 10, and B is a radical of a compound free of diazonium groups and being capable of condensation in at least one position of the molecule with an active carbonyl compound in an acid medium.

Positive-working layers according to German Offenlegungsschrift No. 3,610,842, comprising a compound which splits-off an acid upon irradiation and a compound having at least one COC bond capable of being split by an acid (for example an orthocarboxylic acid ester group or a carboxylic acid amide acetal group) and, optionally, a binder.

Negative-working layers composed of photopolymerizable monomers, photoinitiators, binders and, optionally, further additions. The monomers used in this case are, for example, esters of acrylic or methacrylic acid, or reaction products of diisocyanates and partial esters of polyhydric alcohols, such as are described, for example in U.S. Pat. Nos. 2,760,863 and 3,060,023, and in German Offenlegungsschriften Nos. 2,064,079, and 2,361,041. Suitable photoinitiators are, for example, benzoin, benzoin ethers, multi-nuclear quinones, acridine derivatives, phenazine derivatives, quinoxaline derivatives, quinazoline derivatives, or synergistic mixtures of various ketones. A great number of soluble organic polymers may be used as binders, for example, polyamides, polyesters, alkyd resins, polyvinyl alcohol, polyvinyl pyrrolidone, polyethylene oxide, gelatin, or cellulose ethers.

To sum up, the process according to the invention surprisingly may be used to prepare anodically oxidized strip, foil or sheet-shaped materials of aluminum or aluminum alloys, which have abrasion-resistant, alkali-resistant, and low-porosity surfaces of adequate thickness for many applications. Especially, a support material for printing plates prepared according to this process and coated with a light-sensitive layer does not show any or, at least, only a minor degree of "staining." In the inventive process it is possible to achieve this object by a combination of process features which, by experts, are often regarded as being rather detrimental to the attainment of this object, namely the use of a low total acid concentration, a definite distribution of the proportions of sulfuric and phosphoric acid, $Al^{3+}$ ions in a strong concentration, a relatively high temperature of the electrolyte, a high current density, and a high flow rate of the electrolyte. Although individual features of the process may have become known in certain branches, this does not apply to the combination of all of these features. In spite of the relatively high temperature of the electrolyte, the capability of the electrolyte to re-dissolve particular layer components is within the range of values normally observed with lower electrolyte temperatures. Also "burns" of the aluminum oxide, which are frequently feared in the case of a higher current density, surprisingly, do not occur.

In the following examples the percentages given are related to weight, and the relationship between parts by weight and parts by volume is the same as that of the kilogram to the liter. When evaluating the aluminum materials which had been anodically oxidized according to the inventive process, the following standard methods were used:

Determination of the weight per unit area of aluminum oxide layers by chemical dissolution (according to German Industrial Standard DIN 50944, March 1969 edition): A solution composed of 37 ml of $H_3PO_4$ (density 1.71 g/ml at 20° C., corresponding to 85% concentration $H_3PO_4$), 20 g of $CrO_3$, and 963 ml of distilled $H_2O$ is used to dissolve the aluminum oxide layer from the base metal, at a temperature of from 90° to 95° C., during 5 minutes. The resulting loss of weight is determined by weighing the sample prior to and after dissolving the layer. The loss of weight and the weight of the surface covered by the layer are then taken to calculate the weight per unit area of the layer, which is given in $g/m^2$.

Testing the quality of the sealing of oxide layers produced in an anodization process by staining with dyes (based on German Industrial Standard DIN 50946, June 1968 edition): This qualitative measuring method, particularly when used in combination with an ensuing quantitative determination of the color stimulus specification, indicates whether and to what extent the anodically oxidized surface of an aluminum material tends to "stain." For the purpose of measurement, one half of a planar piece of material of 5 cm×12 cm is, during 20 minutes, immersed in a solution of 0.5 g/l of aluminum blue (®Solway Blue BN 150 of ICI) in distilled $H_2O$, at a temperature ranging from 40° to 45° C.; it is then rinsed with distilled water and dried. The degree of staining is a measure of the quality of the sealing. The lower the amount of dyestuff absorbed, the better the sealing, i.e., the lower the susceptibility of the tested surface to "staining."

Determination of the color stimulus specification (according to DIN 5033, Sheet 1 of July 1962; Sheet 3 of April 1954; Sheet 6 of September 1964; and Sheet 7 of October 1966): In this method the color coefficients for the unstained and the stained portions of a sample (stained with aluminum blue) are determined. Standard illuminant C (spectral distribution of radiation of a gas-filled tungsten incandescent lamp of distribution temperature 2854° K.) is used to determine the three coefficients of the color stimulus specification to be determined. As the result, the trichromatic coefficients of the standard stimulus system can be given, however, in practice (at least in the present case) it is often sufficient to specify one standard tristimulus value or standard chromaticity coordinate only. In determining the color stimulus specification of the sample the difference between the standard chromaticity coordinates $X_I$ of the unstained portion of the sample and $X_{II}$ of the stained portion of the sample is a measure of the sealing of the surface, i.e. the higher the value of the difference, the lower the density of the surface and the sooner "staining" will occur.

Testing the resistance to alkali of the surface (according to U.S. Pat. No. 3,940,321, column 3, lines 29 to 68 and column 4, lines 1 to 8): The rate of dissolving in seconds of an aluminum oxide layer in an alkaline zincate solution is a measure of the alkali resistance of the layer. The longer the time required by the layer to dissolve, the higher its alkali-resistance. The thicknesses of the layers should be approximately comparable, because they are naturally also a parameter of the rate of dissolving. A drop of a solution composed of 500 ml of distilled water, 480 g of KOH, and 80 g of zinc oxide is applied to the surface to be tested, and the time taken for the metallic zinc to appear is measured, which is shown by a black staining of the area tested.

EXAMPLE 1

Bright-rolled aluminum strip having a thickness of 0.3 mm is degreased in an alkaline pickling solution (an aqueous solution containing 20 g of NaOH per liter of the solution) at an elevated temperature of about 50° to 70° C. Electrochemical roughening of the aluminum surface is carried out in an apparatus constructed according to the teaching of German Auslegeschrift No. 2,234,424, using A.C. and an electrolyte containing $HNO_3$. A similar apparatus is employed for the subsequent anodic oxidation using D.C. current is then, however, supplied by way of a contact roller.

The anodizing electrolyte contains 50 g of $H_2SO_4$ per liter, 25 g of $H_3PO_4$ per liter, and 10 g of $Al^{3+}$ per liter, the $Al^{3+}$ ion concentration being obtained by dissolving 123.5 g of $Al_2(SO_4)_3 \cdot 18\ H_2O$ per liter. At a temperature of the bath of 35° C. and a current density of 8 A/dm$^2$ (D.C.) about 3.1 g/m$^2$ of aluminum oxide may be built up during an anodizing time of about 25 seconds. In order to achieve a good exchange of substances and heat, a turbulent flow is produced in the above-mentioned apparatus; the rate of flow of the electrolyte exceeds 0.3 m/second.

A presensitized printing plate is prepared from this material by coating it with a solution having the following components:

0.58 part by weight of the esterification product of 1 mole of 2,2'-dihydroxy-dinaphthyl-(1,1')-methane and 2 moles of naphthoquinone-(1,2)-diazide-(2)-5-sulfonic acid chloride, 1.16 parts by weight of the p-cumyl phenol ester of naphthoquinone-(1,2)-diazide-(2)-4-sulfonic acid, 6.92 parts by weight of a novolak resin (softening range from 112° to 118° C., content of phenolic OH groups 14 percent by weight), 0.08 part by weight of Crystal Violet base, 0.26 part by weight of naphthoquinone-(1,2)-diazide-(2)-4-sulfonic acid chloride, 36.00 parts by weight of ethylene glycol monoethyl ether, 47.00 parts by weight of tetrahydrofuran, and 8.00 parts by weight of butyl acetate.

The weight of the light-sensitive layer applied to the anodized support is about 3 g/m$^2$.

A printing form is prepared by exposing the plate in known manner, followed by development in an aqueous alkaline solution.

About 150,000 prints of good quality may be produced in the offset method from the resulting printing form.

The susceptibility to "staining" of the printing plate is measured by dyeing the plate prior to the application of the light-sensitive layer.

When determining the color stimulus specification, a difference of the chromaticity coordinates $X_I - X_{II} = -1 \cdot 10^3$ is obtained as a measure of the absorption of dyestuff by the surface.

The zincate test results in a measuring time of about 38 seconds. The printing plate support shows only a small degree of "staining," and it has a good resistance to alkali.

EXAMPLE 2

Bright-rolled aluminum strip having a thickness of 0.3 mm is pickled in an alkaline solution and electrochemically roughened as specified in Example 1. The ensuing anodic oxidation is carried out in an apparatus constructed according to the teaching of German Auslegeschrift No. 2,234,424, using an electrolyte which contains 60 g of $H_2SO_4$ per liter, 40 g of $H_3PO_4$ per liter, and 20 g of $Al^{3+}$ per liter. At a temperature of the bath of 35° C. and a current density of 8 A/dm$^2$ about 2.8 g/m$^2$ of aluminum oxide may be built up in 25 seconds. The staining test results in a difference of the chromaticity coordinates $X_I - X_{II} = 4.4 \cdot 10^3$; and the zincate test results in a measuring time of 36 seconds.

Following the application of a light-sensitive layer according to Example 1, about 160,000 prints of good quality may be obtained in the offset method.

If the roughened surface is anodized using the above-specified acid mixture at a temperature of 55° C. and a current density of 12 A/dm$^2$, about 3.4 g/m$^2$ of aluminum oxide are obtained. The difference of the chromaticity coordinates $X_I - X_{II}$ is slightly increased to $9.4 \cdot 10^3$, and the measuring value determined in the zincate test is reduced to 31 seconds. More than 150,000 prints of good quality may be produced in the offset method. In both cases, the oxide layers exhibit a small degree of "staining" and a good resistance to alkali.

EXAMPLE 3

Bright-rolled aluminum strip having a thickness of 0.3 mm is pickled in an alkaline solution and electrochemically roughened as specified in Example 1. Anodic oxidation is carried out in an apparatus constructed according to the teaching of German Auslegeschrift No. 2,234,424, using an electrolyte which contains 50 g of $H_2SO_4$ per liter, 25 g of $H_3PO_4$ per liter and 12 g of $Al^{3+}$ per liter, at a temperature of 55° C., and a current density of 12 A/dm$^2$. Immediately following this procedure, the resulting aluminum oxide surface is anodically treated during 60 seconds in an aqueous solution of 2 g per liter of Na-metasilicate, at a temperature of 25° C., and a current density of 0.9 A/dm$^2$, according to the teaching of German Offenlegungsschrift No. 2,532,769.

3.0 g/m$^2$ of aluminum oxide are obtained, showing a difference of the chromaticity coordinates determined in the staining test of $X_I - X_{II} = 4.0 \cdot 10^3$, and a measuring time of 98 seconds in the zincate test. In this printing plate support the "staining" behavior and the resistance to alkali are clearly improved as compared with the layer produced at 55° C. according to Example 2, and after the application of a light-sensitive layer according to Example 1 it enables the production of at least 150,000 good prints in the offset method. From this it is evident that the use of known conditioning methods is advantageous to lithographic surfaces, also in the case of aluminum oxide layers prepared according to the present invention.

EXAMPLE 4

An aluminum strip material which has been pickled and roughened as specified in Example 1 is anodized in an apparatus according to German Auslegeschrift No. 2,234,424, using an aqueous solution containing 150 g of $H_2SO_4$ per liter, 50 g of $H_3PO_4$ per liter and 5 g of $Al^{3+}$ per liter (added as 61.75 g per liter of $Al_2(SO_4)_3.18H_2O$). At a temperature of 40° C. and a current density of 11 A/dm$^2$ about 2.5 g/m$^2$ of aluminum oxide may be built up in 25 seconds.

Following coating with a light-sensitive layer and processing as described in Example 1, 80,000 good prints may be produced using the printing form thus obtained.

The staining test results in a difference of the chromaticity coordinates $X_I - X_{II} = 12 \cdot 10^3$. The resistance to alkali determined in the zincate test is 31 seconds.

With an increasing total acid concentration the susceptibility to "staining" of the resulting oxide is augmented and its resistance to alkali and the press runs to be achieved are reduced; however, it is still possible to obtain support materials for printing plates which have adequate properties for many purposes.

EXAMPLE 5

An aluminum strip material which has been pickled in an alkaline solution and electrochemically roughened as specified in Example 1 and has a thickness of 0.3 mm is anodically oxidized in a solution containing 50 g of $H_2SO_4$ per liter, 25 g of $H_3PO_4$ per liter and 13 g of $Al^{3+}$ per liter. Instead of in the apparatus according to the teaching of German Auslegeschrift No. 2,234,424 used in Example 1, the process is here carried out in an apparatus in which the agitation of the electrolyte is reduced and which, therefore, yields a poorer exchange of substances and heat; an apparatus of this kind is, for example, described in German Auslegeschrift No. 1,621,115, column 3, lines 1 to 10.

At a temperature of 40° C. and a current density of 6 A/dm$^2$ about 2.7 g/m$^2$ of aluminum oxide may be produced in 30 seconds. The difference of the chromaticity coordinates $X_I - X_{II} = 23.9 \cdot 10^3$ determined in the staining test and the resistance to alkali of 41 seconds determined in the zincate test show an increase or decrease, respectively, as compared with the oxide layers obtained under more favorable conditions according to German Auslegeschrift No. 2,234,424; the values measured are, however, still far better than in the case of comparative oxide layers which are prepared in sulfuric acid used as the only electrolytic acid. Following coating with a light-sensitive mixture according to Example 1, more than 150,000 good prints may be produced in the offset method.

If anodizing is carried out at 55° C. and 12 A/dm$^2$, about 3.4 g/m$^2$ of oxide are formed in 30 seconds. On account of the slightly less favorable conditions of formation (elevated temperature, small exchange of substances and heat) the staining test performed on this oxide results in a difference of the chromaticity coordinates $X_I - X_{II} = 32 \cdot 10^3$, and the zincate test shows a slightly reduced resistance to alkali (36 seconds).

Nevertheless, after coating with a light-sensitive layer as described in Example 1, more than 150,000 good prints may be produced using this printing plate support.

This Example shows the wide range of applicability of the anodizing electrolytes according to the present invention, which, even under less favorable anodizing conditions, still yield clear improvements in the properties of the oxide layer.

EXAMPLE 6

Bright-rolled aluminum strip having a thickness of 0.3 mm is degreased in an alkaline solution, electrochemically roughened and anodically oxidized as specified in Example 1. The electrolyte used in the anodic oxidation contains 25 g of $H_2SO_4$ per liter, 25 g of $H_3PO_4$ per liter, and 5 g of $Al^{3+}$ per liter. At a temperature of the bath of 55° C. and a current density of 8 A/dm$^2$ about 1.95 g/m$^2$ of oxide may be built up in 25 seconds. The material which has not been conditioned has a resistance to alkali of 63 seconds, determined in the zincate test.

The aluminum support is then during 4 minutes immersed in a 0.1 percent by weight aqueous solution of polyvinyl phosphonic acid (molecular weight about 100,000) having a temperature of 60° C., to prepare the surface for the subsequent sensitizing.

The light-sensitive coating applied has the following composition: 1.4 parts by weight of a mixed condensate of 1 mole of 3-methoxy-diphenylamine-4-diazonium sulfate and 1 mole of 4,4'-bis-methoxy-methyl diphenyl ether, prepared in a 85 percent by weight aqueous phosphoric acid and precipitated as the mesitylene sulfonate, 0.2 part by weight of p-toluene sulfonic acid monohydrate, 3 parts by weight of polyvinyl butyral (containing from 69 to 71% of polyvinyl butyral units, 1% of polyvinyl acetate units, and from 24 to 27% of polyvinyl alcohol units, the viscosity of a 5% by weight solution in butanol at 20° C. ranging between 20 and 30 mPa·s), 80 parts by volume of ethylene glycol monomethyl ether and 20 parts by volume of butyl acetate. The diazo mixed condensate layer is exposed under a negative and is then developed using a mixture of 50 parts by weight of water, 15 parts by weight of isopropanol, 20 parts by weight of n-propanol, 12.5 parts by weight of n-propyl acetate, 1.5 parts by weight of polyacrylic acid, and 1.5 parts by weight of acetic acid.

The printing form thus obtained permits the production of very good prints. The image-free areas are free from "staining." Oxide layers prepared according to the invention, therefore, enable an unrestricted application of the methods and chemicals which are conventionally employed for improving the behavior of negative layers.

EXAMPLE 7

A roughened aluminum strip prepared as described in Example 1 is anodically oxidized in an electrolyte containing 50 g of $H_2SO_4$ per liter, 25 g of $H_3PO_4$ per liter and 12 g of $Al^{3+}$ per liter. At a temperature of the bath of 55° C. and a current density of 12 A/dm$^2$, 3.1 g/m$^2$ of aluminum oxide may thus be built up in 30 seconds. The staining test results in a difference of the chromaticity coordinates $X_I - X_{II} = 9.5 \cdot 10^3$, and the time measured in the zincate test is about 34 seconds.

The light-sensitive coating applied may be composed of a positive-working solution, as described in Example 1, but also of a negative-working photopolymeric solution having the following components:

1.4 parts by weight of a copolymer of methyl methacrylate and methacrylic acid, having an average molecular weight of 36,000 and an acid number of 95,
1.4 parts by weight of pentaerythritol triacrylate,
0.05 part by weight of 9-phenyl-acridine,
0.2 part by weight of 1,6-dihydroxy ethoxy hexane,
0.02 part by weight of the phenazine dye "Supranol Blue GL", and
16.0 parts by weight of methyl ethyl ketone.

The aluminum support coated with 5 g/m$^2$ of this photopolymeric layer is additionally provided with a covering layer of about 1 g/m$^2$, which is prepared from the following solution:

2.0 parts by weight of cane sugar,
1.0 part by weight of methyl cellulose having an average viscosity of 50 c Pa·s, and
0.15 part by weight of saponin in
96.85 parts by volume of water.

Following exposure and development in the manner described in German Pat. No. 1,193,366, a printing form is obtained which is free from "staining" in the image-free areas and yields long press runs.

COMPARATIVE EXAMPLE V1

An aluminum strip which has been cleaned in an alkaline solution and electrochemically roughened as specified in Example 1, is anodically oxidized in an aqueous electrolyte containing 100 g of $H_3PO_4$ per liter as the only electrolytic acid. In an apparatus constructed according to German Auslegeschrift No. 2,234,424 and equipped with a contact roller 0.85 g/m$^2$ of aluminum oxide may be built up in about 25 seconds, at a temperature of the bath of 40° C. and a current density of 4 A/dm$^2$.

Measured in the zincate test, the material obtained has a moderate resistance to alkali (16 seconds) and its tendency towards "staining," evaluated in the staining test, is very low (difference of chromaticity coordinates $X_I - X_{II}$ about $1 \cdot 10^3$).

The oxide layer which may still be built up without producing any burns, but which is already thin, has a poor resistance to alkali and thus clearly exhibits the disadvantages of the use of phosphoric acid as the only anodizing electrolyte, but it also shows the advantage of a very low susceptibility to "staining."

If about 20 g of $Al^{3+}$ per liter are added as 246.8 g per liter of $Al_2(SO_4)_3.18H_2O$, with the other conditions remaining unchanged (100 g per liter of $H_3PO_4$, 40° C., 25 seconds dwell, 4 A/dm$^2$), a certain positive effect is already achieved in view of a slightly higher weight of the oxide of 0.95 g/m$^2$, an improved resistance to alkali, amounting to 22 seconds in the zincate test, and an only slightly increased susceptibility to "staining" (difference of chromaticity coordinates $X_I - X_{II} = 4 \cdot 10^3$); however, the thickness of the oxide layer, in particular, does not yet permit an economical procedure.

COMPARATIVE EXAMPLE V2

An aluminum strip having a thickness of 0.3 mm is pickled in an alkaline solution, electrochemically roughened, and anodically oxidized as specified in Example 1. Anodic oxidation is, however, carried out in an electrolyte containing 150 g of $H_2SO_4$ per liter and 5 g of $Al^{3+}$ per liter. At a temperature of the bath of 40° C. and a current density of 12 A/dm$^2$, about 2.8 g/m$^2$ of aluminum oxide may be built up in 30 seconds. The staining test results in a difference of the chromaticity coordinates $X_I - X_{II} = 27 \cdot 10^3$. In the zincate test the oxide layer is already penetrated after 22 seconds.

Following coating with a light-sensitive mixture according to Example 1 a printing plate is obtained which shows a high degree of "staining" after exposure and development. About 140,000 good prints may be produced in the offset method.

If in the anodic oxidation, the temperature is increased to 55° C. and the current density to 16 A/dm$^2$, about 3.4 g/m$^2$ of oxide may be produced. The difference of the chromaticity coordinates $X_I - X_{II}$ determined in the staining test then increases to $42 \cdot 10^3$, while the resistance in the zincate test decreases to 16 seconds. Example 2, on the other hand, shows the improvement which may be obtained according to the present invention with respect to the staining test (i.e. reduced degree of "staining") and the resistance to alkali, at likewise increased temperature and current density.

The support coated with a light-sensitive mixture according to Example 1 exhibits a very high degree of "staining" after exposure and development. About 95,000 prints of good quality only may be prepared in the offset method.

COMPARATIVE EXAMPLE V3

Bright-rolled aluminum strip is pretreated and anodically oxidized as described in Example 1. The anodic oxidation is carried out in an electrolyte containing 75 g of $H_2SO_4$ per liter and 20 g of $Al^{3+}$ per liter (according to the teaching of German Offenlegungsschrift No. 2,811,396).

At a temperature of the bath of 40° C. and a current density of 9 A/dm$^2$ about 2.5 g/m$^2$ of aluminum oxide may be built up. The staining test results in a difference of the chromaticity coordinates $X_I - X_{II} = 16 \cdot 10^3$, and in the zincate test 32 seconds are measured.

After coating the plate with the light-sensitive mixture described in Example 1, about 150,000 prints of good quality may be produced from the exposed and developed printing plate.

A comparison with the material of Example 1 which is prepared using the same acid concentration, shows the advantage resulting from the application of the inventive process, even over the process here described, which is already a substantially improved process.

COMPARATIVE EXAMPLE V4

Aluminum strip sections which have been pretreated in an alkaline solution and electrochemically roughened as specified in Example 1 are anodically oxidized for 30 seconds at 30° C. and at a current density of 8 A/dm$^2$, using $H_2SO_4$ or mixtures of $H_2SO_4/H_3PO_4$ of different concentrations with and without the addition of aluminum ions (added as $Al_2(SO_4)_3.18H_2O$). The compositions of the anodizing electrolytes, conductivities and thicknesses of the oxide layers produced as well as their staining behaviors are listed in the table which follows.

It is shown that, as a rule, the addition of aluminum ions promotes the thickness growth of the oxide layers and strongly contributes towards a reduction of stainability, expressed as the difference of the chromaticity coordinates $X_I - X_{II}$. This result is particularly significant in the case of the lower total acid concentrations preferred according to the present invention. The addition of aluminum ions reduces the specific conductivity at higher total acid concentrations, in the case of the lower acid concentrations preferred according to the present invention, however, the conditions are unexpectedly reversed in most cases, i.e. the addition of aluminum ions improves the specific conductivity, and, as a consequence, the economy of the process is also improved.

TABLE

| Concentration in g of electrolyte/liter of | | | specific conductivity (S/cm) | weight of oxide ($g/m^2$) | difference of chromaticity coordinates $(X_I-X_{II}) \cdot 10^3$ | remarks |
|---|---|---|---|---|---|---|
| $H_2SO_4$ | $H_3PO_4$ | $Al^{3+}$ | | | | |
| 150 | — | — | 0.388 | 2.8 | 27.6 | prior art |
| 150 | — | 5 | 0.344 | 4.4 | 26.4 | prior art |
| 125 | 25 | — | 0.344 | 2.5 | 8.1 | prior art |
| 125 | 25 | 5 | 0.301 | 2.4 | 7.0 | according to invention |
| 75 | 75 | — | 0.240 | 1.3 | 28.0 | prior art |
| 75 | 75 | 5 | 0.172 | 1.8 | 14.6 | not according to invention |
| 50 | 25 | — | 0.158 | 1.2 | 1.9 | prior art |
| 50 | 25 | 5 | 0.169 | 1.4 | 1.2 | according to invention |
| 25 | 50 | — | 0.111 | 1.0 | 5.5 | prior art |
| 25 | 50 | 5 | 0.125 | 2.0 | 0.7 | according to invention |
| 25 | 25 | — | 0.107 | 1.5 | 1.5 | prior art |
| 25 | 25 | 5 | 0.100 | 1.8 | 1.5 | according to invention |

It will be obvious to those skilled in the art that many modifications may be made within the scope of the present invention without departing from the spirit thereof, and the invention includes all such modifications.

What is claimed is:

1. In the process for anodically oxidizing materials in the form of strips, foils, or sheets composed of aluminum or aluminum alloys in an aqueous electrolyte containing sulfuric acid and phosphoric acid, if appropriate, after a previous mechanical, chemical or electrochemical roughening, the improvement which comprises anodically oxidizing the material in an electrolyte having a concentration of sulfuric acid ranging from about 25 to 150 g per liter, of phosphoric acid ranging from about 10 to 50 g per liter, and of aluminum ions ranging from about 5 to 25 g per liter, at a current density ranging from about 4 to 25 $A/dm^2$, and a temperature ranging from about 25° to 65° C.

2. A process according to claim 1 in which the material is anodically oxidized in an electrolyte having a concentration of sulfuric acid ranging from 25 to 100 g per liter, of phosphoric acid ranging from 20 to 40 g per liter, and of aluminum ions from at least 10 g per liter, preferably ranging from 12 to 20 g per liter, at a current density ranging from 6 to 15 $A/dm^2$, and a temperature ranging from 35° to 55° C.

3. A process according to claim 1 in which the anodically oxidized material is a support material for printing plates.

4. A process according to claim 3 including applying a light-sensitive layer to said support material.

5. A process according to claim 4 in which said light-sensitive layer contains a diazo compound, a diazoquinone, a diazo mixed condensate, or a photopolymerizable compound.

* * * * *